United States Patent [19]

Chuparov et al.

[11] 4,062,219

[45] Dec. 13, 1977

[54] HYDRAULIC-FRICTIONAL SYSTEM FOR ROTATING THE ARM OF A FORGING MANIPULATOR

[75] Inventors: Nikola Tomov Chuparov; Dobri Tzvetkov Pakyov; Peter Nachev Papazov; Tzvetan Mladenov Savov, all of Sofia, Bulgaria

[73] Assignee: VMEI "Lenin" - NIS, Sofia, Bulgaria

[21] Appl. No.: 666,213

[22] Filed: Mar. 12, 1976

[30] Foreign Application Priority Data

Mar. 13, 1975 Bulgaria ..... 29253

[51] Int. Cl.[2] ..... B21D 43/10; B21D 43/11

[52] U.S. Cl. ..... 72/422; 91/178; 91/194; 91/275; 92/68

[58] Field of Search ..... 72/422; 92/68; 74/128, 74/142; 91/176, 178, 275, 194, 459

[56] References Cited

U.S. PATENT DOCUMENTS

| | | | |
|---|---|---|---|
| 3,018,986 | 1/1962 | Cameron-Johnson | 91/438 |
| 3,431,822 | 3/1969 | Gross | 91/275 |
| 3,434,387 | 3/1969 | Ellis | 92/68 |
| 3,515,009 | 6/1970 | Matusch | 74/128 |
| 3,915,064 | 10/1975 | Dancs | 92/68 |

FOREIGN PATENT DOCUMENTS

| | | | |
|---|---|---|---|
| 1,094,329 | 12/1967 | United Kingdom | 72/422 |

*Primary Examiner*—Martin P. Schwadron
*Assistant Examiner*—Abraham Hershkovitz
*Attorney, Agent, or Firm*—Karl F. Ross

[57] ABSTRACT

The arm of a forging manipulator has tongues at one end for engaging with a workpiece and is journaled for rotation about a horizontal axis. At the other end the arm carries a pair of clamps each of which has a pair of clamping jaws pivotally connected at one end and adapted to be spread apart or drawn against the arm by a spreading hydraulic cylinder at the other end of each pair of jaws. The cylinders are interconnected for reversing operation and are hydraulically linked to a pair of drive cylinders, the pistons of which are pivotally connected to the respective clamps so that one of the drive cylinders is effective to rotate the arm when its clamping cylinder draws its jaws against the arm while the other clamping cylinder spreads the other pair of jaws apart during the ineffective stroke of the drive piston.

4 Claims, 3 Drawing Figures

HYDRAULIC-FRICTIONAL SYSTEM FOR ROTATING THE ARM OF A FORGING MANIPULATOR

FIELD OF THE INVENTION

This invention relates to a hydraulic-frictional system for rotating the arm of a forging manipulator.

BACKGROUND OF THE INVENTION

A system for rotating the arm of a forging manipulator is known, this system uses an electric motor, a slip clutch and a reduction gear. The change in direction of rotation of the arm is effected by reversing the electric motor. This system does not permit any change in the velocity of rotation of the armor a smooth starting and stopping. For this reason, such drives are very rarely found in contemporary forging manipulators.

In another system the rotation of the arm is effected by means of an electric motor and a special variable speed gear drive structure (normally the gear drive is planetary, and in the case of (e.g. a differential). This system, too, does not permit any change in the velocity of rotation, while being expensive and requiring a complex epicyclic toothed wheel.

In yet another system a double-acting hydraulic cylinder, a toothed rack, a toothed wheel and a compound gear drive with hydraulic switching, reverses automatically the direction of rotation of the arm during the back stroke of the rack. This system is very complex and expensive and increases the dimensions of the manipulator in a horizontal plane.

Still another system makes use of eight hydraulic cylinders, four toothed racks, four toothed wheels and four free-wheeling clutches. This system, too, is very complex and expensive and increases the horizontal dimensions of the manipulator.

Finally a prior-art system comprises a hydromotor and a gear drive. It is at the present the most widespread in use, although it is comparatively complex and expensive.

OBJECT OF THE INVENTION

It is, therefore, the object of the present invention to avoid the disadvantages of the known designs and to provide a simplified, easily controlled system for rotating the arm of a forging manipulator, in which the continuous rotation of the arm is produced by a reciprocating motion.

SUMMARY OF THE INVENTION

In accordance with the invention, this object is achieved by two clamps, disposed onto journals of the arm, which have jaws pivotally connected at one end. To these clamps are pivotally connected the piston rods of two double-acting hydraulic cylinders fastened to the base frame. The other end of the jaws of each clamp is provided a small double-acting hydraulic cylinder. The bottom and the upper space (below and above the piston) of one cylinder being connected by means of two pipe conduits correspondingly to the upper and the bottom working space of the other. These pipe conduits are connected by means of an electromagnetically actuated distributor to the one or the other pipe conduits, which connect the bottom and the upper working spaces of the hydraulic cylinders fastened to the base frame, by means of a distributor, actuated electromagnetically by limit switches, and a spool valve.

The advantage of the hydraulic-frictional system for rotating the arm of a forging manipulator, in accordance with the present invention, lie in that the continuous bidirectional rotation of the arm is effected by hydraulic cylinders without reversing an electric motor and without the use of gear drives.

A further advantage is that it enables stepless regulating of the revolutions of the arm, and smooth starting and stopping of the arm, since in the beginning of the stroke of the drive piston the velocity of rotation of the arm is at its lowest, it increases gradually, and it decreases again at the end of the stroke.

A further advantage is the possibility for operation of the hammer and the press for continuous rotation of the arm, i.e. in the case of overloading, the mechanism rotating the trunk is automatically switched-off.

SPECIFIC DESCRIPTION

Figure 2:
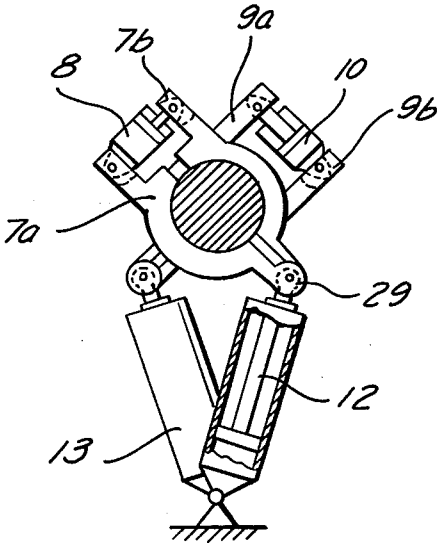
FIG. 2 is a cross-sectional view of the arm taken along the line 2—2 of FIG. 1.
Figure 1:
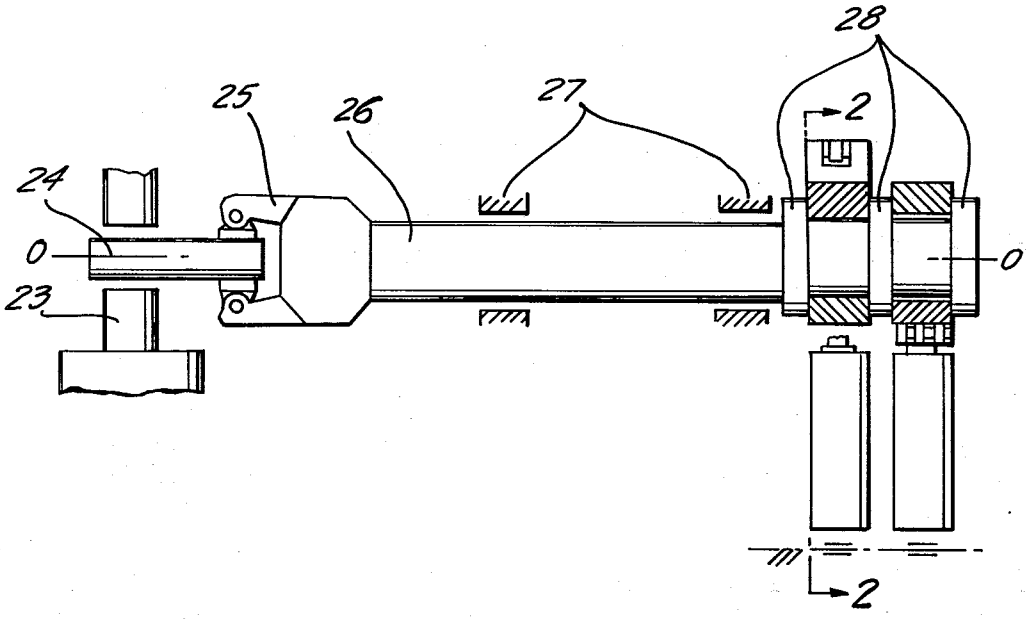
FIG. 1 is an axial cross-sectional view of the arm.

The hydraulic-frictional system for rotating the arm of a forging manipulator comprises the pair of clamps with jaws *7a, 7b, 9a* and *9b,* which lie freely on respective jorunals formed between annular flanges 28 of arm 26, rotatable in bearings 27. To the pivots 29 of clamps *7a, 7b, 9a, 9b* there are attached the pistons of the double-acting hydraulic drive cylinders 12 and 13. At their other ends clamps *7a, 7b, 9a, 9b* are connected by the double-acting small hydraulic speeding cylinders 8 and 10. The hydraulic system comprises a pump unit 1 (FIG. 3), an oil reservoir 2, a stopper valve 3, actuated by control lever 4, a two-position distributor 5 with electromagnetic actuator 17 connected to limit switches 14 and 15, a two-position distributor 11 with electromagnetic actuator 18 connected to control lever 4, a discharge regulator 16, a safety valve 6, conduits 19, 20, 21 and 22, and horizontal conduits *19a, 20a.*

The hydraulic-frictional system for rotating the arm of forging manipulators operates as follows:

The pistons of the double-acting hydraulic cylinders 12 and 13 move simultaneously upwards and downwards, and at that, the separate the cylinders into rod and head chambers and clamps *7a, 7b, 9a, 9b* will perform, if not held against the arm 26 by the small cylinders 8 and 10, an oscillating rotation around axis 0-0 of the arm 26. If during the motion of the pistons of cylinders 12 and 13 upwards the small cylinder 8 has drawn jaws *7a* and *7b* toward each other and small cylinder 10 has spread jaws *9a* and *9b* apart, then clamp jaws *7a* and *7b* will rotate the arm counter-clockwise, while clamp jaws *9a* and *9b* will rotate freely over the journal of the arm. If during the back stroke of the pistons of cylinders 12 and 13 (downward motion) the small cylinder 8 opens clamp jaws *7a* and *7b* and the small cylinder 10 draws clamp jaws *9a* and *9b* together, then the latter will continue to rotate the trunk 26 counter-clockwise, while clamp jaws *7a* and *7b* will rotate freely over the journal of arm 26. Thus, the reciprocating motion of the pistons of cylinders 12 and 13 is transformed into a uni-directional rotation of trunk 26. If during the upward motion of the pistons of cylinders 12 and 13 the clamps *7a* and *7b* are open, and clamps *9a* and *9b* are closed and during the motion of the pistons of cylinders 12 and 13 downwards clamps *7a* and *7b* are closed while clamps *9a* and *9b* are open, then arm 26 will rotate clockwise and together with it the tongs 25, engaging the workpiece 24.

The hydraulic system operates as follows:

The hydraulic unit 1 draws oil from reservoir 2 and delivers it under pressure to its outlet. The two-position valve 3 cuts off or connects the hydraulic unit 1 with the oil-conduit system. The pressure in the whole hydraulic system is regulated and controlled by safety valve 6. When valve 3 is closed, the oil delivered under pressure by the hydraulic unit 1 passes through valve 6 directly into the overflow pipe. When valve 3 is opened, the pressurized oil enters the two-position distributor 5, which delivers oil into conduit 19 or conduit 20. The position of the piston of distributor 5 is determined by the electromagnetic drive 17. The oil conduits 19 and 20 are connected through the discharge regulators 16 correspondingly to the bottom and the upper working spaces of cylinders 12 and 13. Oil enters through the horizontal conduits *19a* and *20a*, branching-off from conduits 19 and 20, into the two-position distributor 11, the position of the piston of the latter being determined by the electromagnetic drive 18. Distributor 11 delivers oil either to pipe conduit 21, or to conduit 22. Conduit 21 is connected to the bottom working space of small cylinder 8 and to the upper working space of small cylinder 10, while conduit 22 is connected to the upper working space of small cylinder 8 and to the bottom working space of small cylinder 10. The electromagnetic drive 17 is actuated by limit switches 14 and 15, which are actuated by lug $9b_1$ of clamp jaws *9b*. Electromagnetic drive 18 is actuated manually by control lever 4, when it is moved into its left or right position. In its neutral position of lever 4 the electromagnetic drive 18 is not actuated and valve 3 receives a signal for opening.

Figure 3:
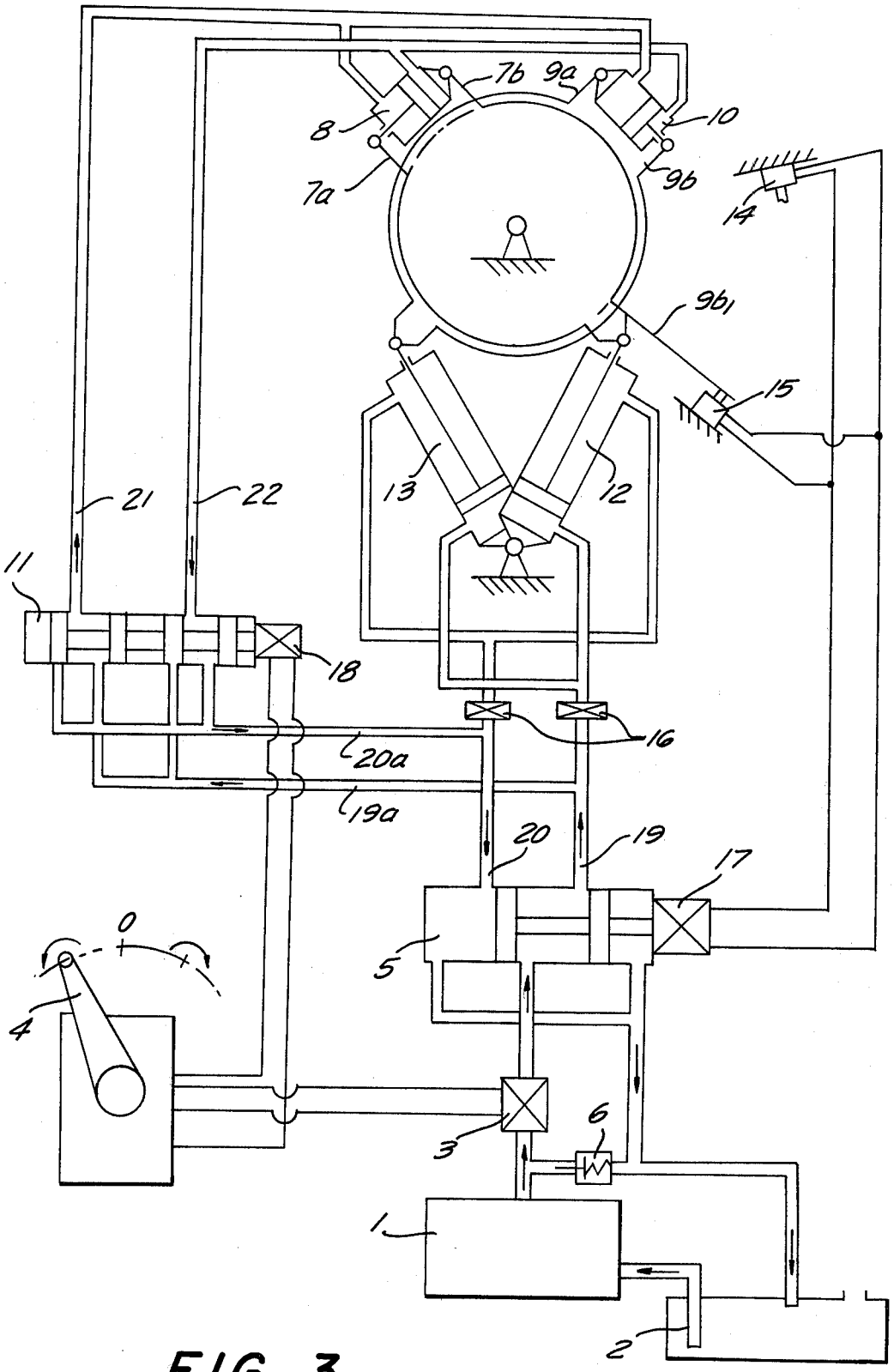
FIG. 3 is a diagrammatical illustration of the hydraulic system and its connection to the elements shown in FIG. 2.

For the position of the pistons of the distributors 5 and 11, shown in FIG. 3, the oil flow is indicated by arrows. The pistons of cylinders 12 and 13 move upwards, small cylinder 8 has pressed clamp jaws *7a* and *7b* onto arm 26, while the piston of 10 has opened the clamp jaws *9a* and *9b*. Thus, trunk 26 will rotate counter-clockwise until lug *9b1* actuates the limit switch 14, which transmits a pulse in the electromagnetic drive 17, causing the displcement of the piston of distributor 5 to the left (according to FIG. 3. At this moment the conduit 20, and not 19 is pressurized, and the pistons of cylinders 12 and 13 start to move downwards. However, at the same time pipe conduit 22 is also under pressure, so that the small cylinder 8 releases clamps *7a* and *7b*, while small cylinder 10 tightens clamps *9a* and *9b*; for this reason the rotation of trunk 26 continues counter-clockwise until limit switch 15 is actuated, and then the cycle is repeated automatically until lever 4 is not brought in neutral position, thus closing valve 3, and the rotation of trunk 26 is stopped. If then lever 4 is again brought into its left position, the system continues to operate as described and trunk 26 begins again to rotate counter-clockwise.

If, however, lever 4 is brought into its right position, the electromagnetic drive 18 receives a pulse and displaces the piston of the distributor 11 from its right position (according to FIG. 3) into its left position, and the horizontal pipe conduit *19a* is connected to pipe conduit 22, while the horizontal conduit *20a* is connected to pipe conduit 21, and not the opposite, as it has been until this moment. In this case, when the pistons of cylinders 12 and 13 are moving upwards, the small cylinders 8 opens clamp jaws *7a* and *7b* while small cylinder 10 tightens clamp jaws *9a* and *9b*, and vice versa — when the pistons of cylinders 12 and 13 move downwards, clamps *7a* and *7b* are tightened, while clamps *9a* and *9b* are opened and trunk 26 begins to rotate clockwise.

The stepless change of the velocity of rotation of trunk 26 is effected by means of the hydraulic discharge regulators 16.

The velocity of rotation of trunk 26 is not constant, since only at one point do the axes of cylinder 12 and 13 coincide with the directions of the linear velocities of pivots 29. But this is not a disadvantage since, first, the change of this velocity if desired by means of changing the position of the limit switches 14 and 15 (FIG. 3) can be made very small and, second, in a number of cases this may be favorable, since at the start of the stroke of the pistons of cylinders 12 and 13 the velocity is the lowest, it increases gradually, and at the end of the stroke decreases again.

What we claim is:

1. A hydraulic-frictional system for operating a forging manipulator, comprising:

a forging-manipulator arm journaled for rotation about a horizontal axis and carrying tongs engageable with a workpiece;

first and second clamps surrounding said arm and each having a pair of clamping jaws adapted to embrace said arm upon displacement of the jaws of each clamp toward one another and to allow free rotation of said arm relative to the respective clamps in a spread-apart position of the jaws thereof, each pair of jaws being pivotally connected at one end and being provided at its other end with a respective double-acting hydraulic clamping cylinder adapted to displace the jaws of each pair toward and away from one another;

respective double-acting power cylinders each pivotally connected to a separate one of said clamps, said power cylinders having a head chamber and a rod chamber;

conduit means hydraulically connecting pressurizable compartments of said clamping cylinders for inverse operation whereby one of said clamps seizes said arm while the other of said clamps permits free rotation thereof; and means for alternately pressurizing one of said head or rod chambers of said power cylinders to rotate said first and second clamps, said one clamp seizing said arm and thereby displacing it while the other of said clamps being rotated without affecting rotation of said arm.

2. The system defined in claim 1 wherein said means for pressurizing includes a source of hydraulic fluid, a distributor disposed between said source and said power cylinders for alternatingly feeding fluid under pressure to said head and rod chambers in alternate positions of said distributor;

limit switch means responsive to the angular positions of at least one of said clamps and operatively connected to said distributor for shifting same between the alternate positions thereof, and manually controlled means for blocking the flow of fluid from said source to said clamping and power cylinders.

3. The system defined in claim 2 further comprising reversible valve means connected between the output of said distributor and said conduit means.

4. The system defined in claim 3, further comprising flow control means between said distributor for each of said power cylinders for regulating the rate of operations thereof and the angular velocity of said arm.

* * * * *